US006332646B1

(12) United States Patent
Tseng

(10) Patent No.: US 6,332,646 B1
(45) Date of Patent: Dec. 25, 2001

(54) FOLDABLE CHAIR FRAME

(76) Inventor: Chun-Hsien Tseng, No. 3, Ting-Hsi-Hsin, Lu-Man Tsun, Chu-Chi Hsiang, Chiayi Hsien (TW)

( * ) Notice: Subject to any disclaimer, the term of this patent is extended or adjusted under 35 U.S.C. 154(b) by 0 days.

(21) Appl. No.: 09/626,396

(22) Filed: Jul. 26, 2000

(51) Int. Cl.[7] ..... A47C 4/00; A47C 4/44; A47C 4/48

(52) U.S. Cl. ..... 297/16.1; 297/19; 297/46; 297/56

(58) Field of Search ..... 297/16.1, 16.2, 297/19, 46, 56, 50, 21, 22, 79

(56) References Cited

U.S. PATENT DOCUMENTS 2,902,084 * 9/1959 Stevens ..... 297/21
3,004,793 * 10/1961 Loomis ..... 297/56
3,123,396 * 3/1964 Searle ..... 297/21
5,893,604 * 4/1999 Yao ..... 297/16.1

* cited by examiner

*Primary Examiner*—Anthony D. Barfield
(74) *Attorney, Agent, or Firm*—Jacobson & Holman, PLLC

(57) ABSTRACT

A foldable chair frame includes pivotally connected front and rear legs. The front leg has a tubular upper end portion which confines an axial insert hole and which is formed with a radial positioning hole. An extension rod has a lower end portion extending axially into the upper end portion of the front leg, and is provided with a resilient positioning protrusion which projects radially into the positioning hole for positioning the extension rod on the front leg. A seat frame has a rear part pivoted to the upper end portion of the extension rod, and a front part pivoted to the upper end portion of the rear leg. The positioning protrusion is depressible for disengaging from the positioning hole to permit retraction of the extension rod into the front leg, thereby permitting folding of the front and rear legs toward the seat frame.

8 Claims, 5 Drawing Sheets

FOLDABLE CHAIR FRAME

BACKGROUND OF THE INVENTION

1. Field of the Invention

The present invention relates to a foldable chair frame, more particularly to a foldable chair frame with a relatively simple structure.

2. Description of the Related Art

Foldable chairs with backrests are known in the art. The conventional foldable chair of this type generally includes a backrest frame, a seat frame pivoted to the backrest frame, and front and rear legs pivoted to the seat frame and the backrest frame and further pivoted to each other. When the chair is folded, the seat frame is usually folded on the backrest frame, and the front and rear legs are folded on the seat frame. The conventional foldable chair as such occupies a relatively large amount of storage space after folding.

SUMMARY OF THE INVENTION

Therefore, the main object of the present invention is to provide a foldable chair frame with a relatively simple structure and a reduced thickness after folding.

Accordingly, the foldable chair frame of the present invention includes a front leg, a rear leg, an adjustable extension rod, and a seat frame. The front leg has a lower end portion adapted to be supported on a ground surface, a tubular upper end portion which extends upwardly and rearwardly from the lower end portion and which confines an axial insert hole with a top opening, and an intermediate portion between the lower end portion and the tubular upper end portion. The upper end portion is formed with at least one radial positioning hole. The rear leg has a lower end portion adapted to be supported on the ground surface, an upper end portion which extends upwardly and forwardly from the lower end portion of the rear leg, and an intermediate portion connected pivotally to the intermediate portion of the front leg. The adjustable extension rod has a lower end portion extending into the axial insert hole in the upper end portion of the front leg via the top opening, and an upper end portion. The lower end portion of the extension rod is provided with a resilient positioning protrusion which projects radially into the positioning hole for engaging the positioning hole so as to position the lower end portion of the extension rod on the upper end portion of the front leg. The seat frame is disposed above the front and rear legs and the extension rod, and has a rear part connected pivotally to the upper end portion of the extension rod, and a front part connected pivotally to the upper end portion of the rear leg. The positioning protrusion is depressible for disengaging from the positioning hole to permit sliding movement of the extension rod relative to the front leg, thereby permitting the extension rod to retract into the upper end portion of the front leg, and thereby permitting folding of the front and rear legs toward the seat frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
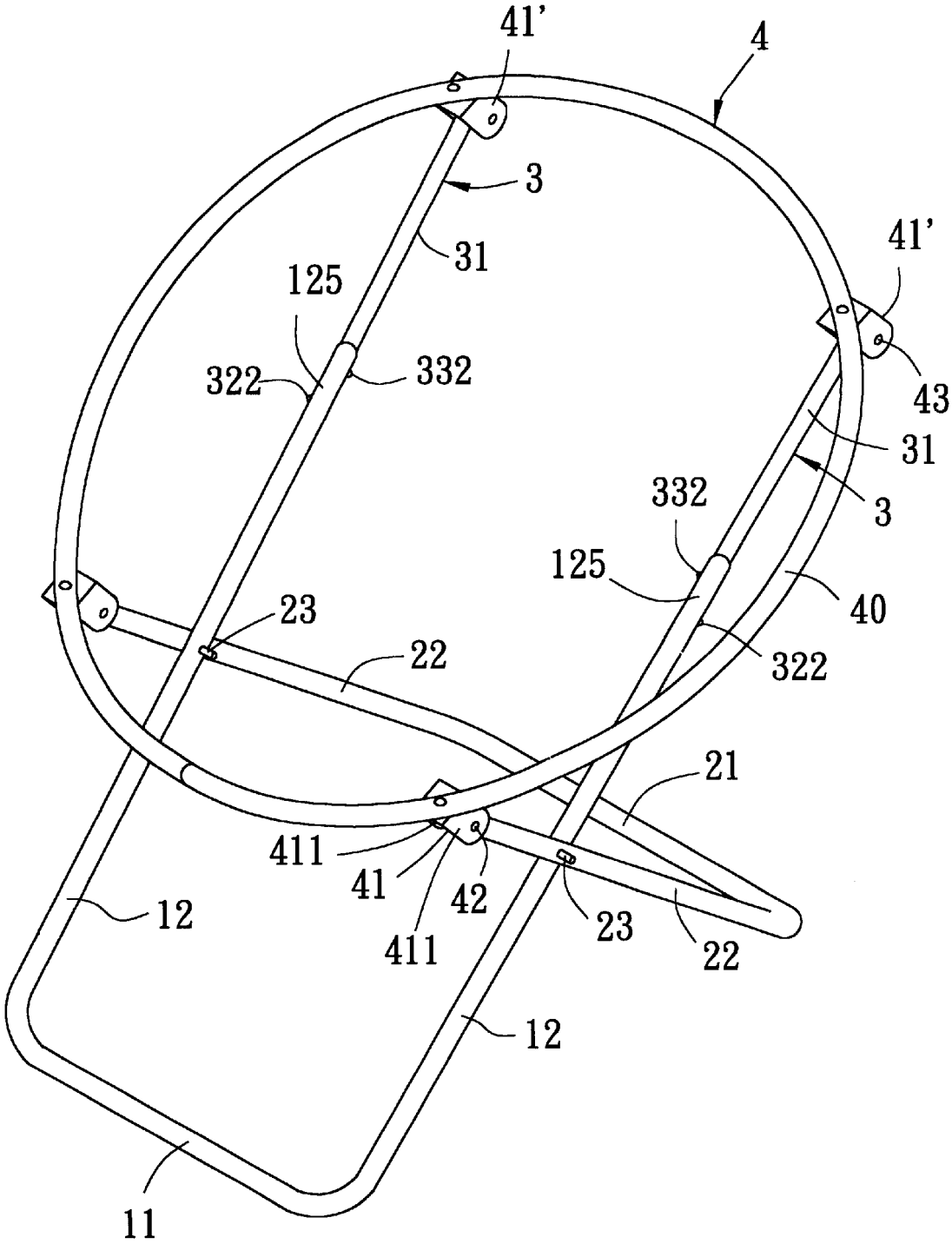
FIG. 1 is a perspective view of a preferred embodiment of the foldable chair frame of the present invention.
Figure 2:
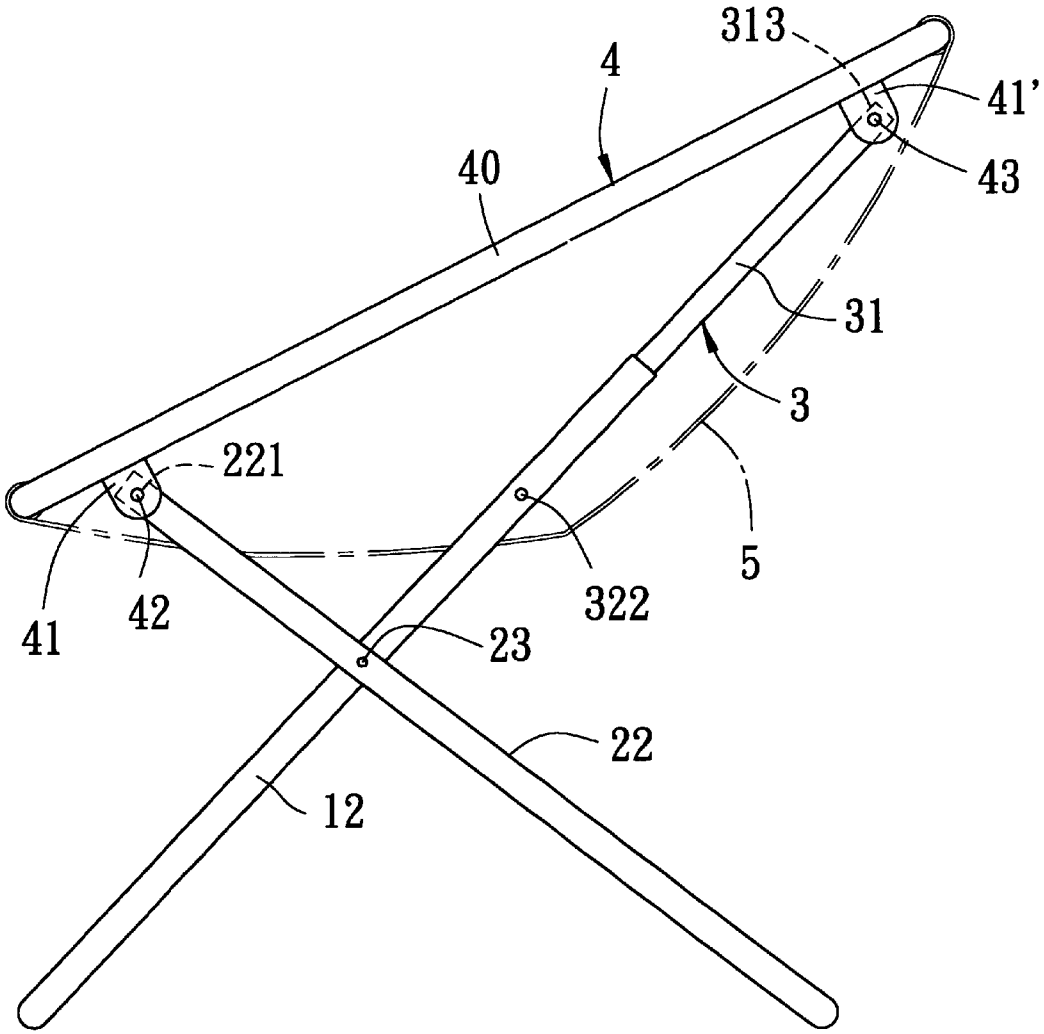
FIG. 2 is a side view of the preferred embodiment.
Figure 3:
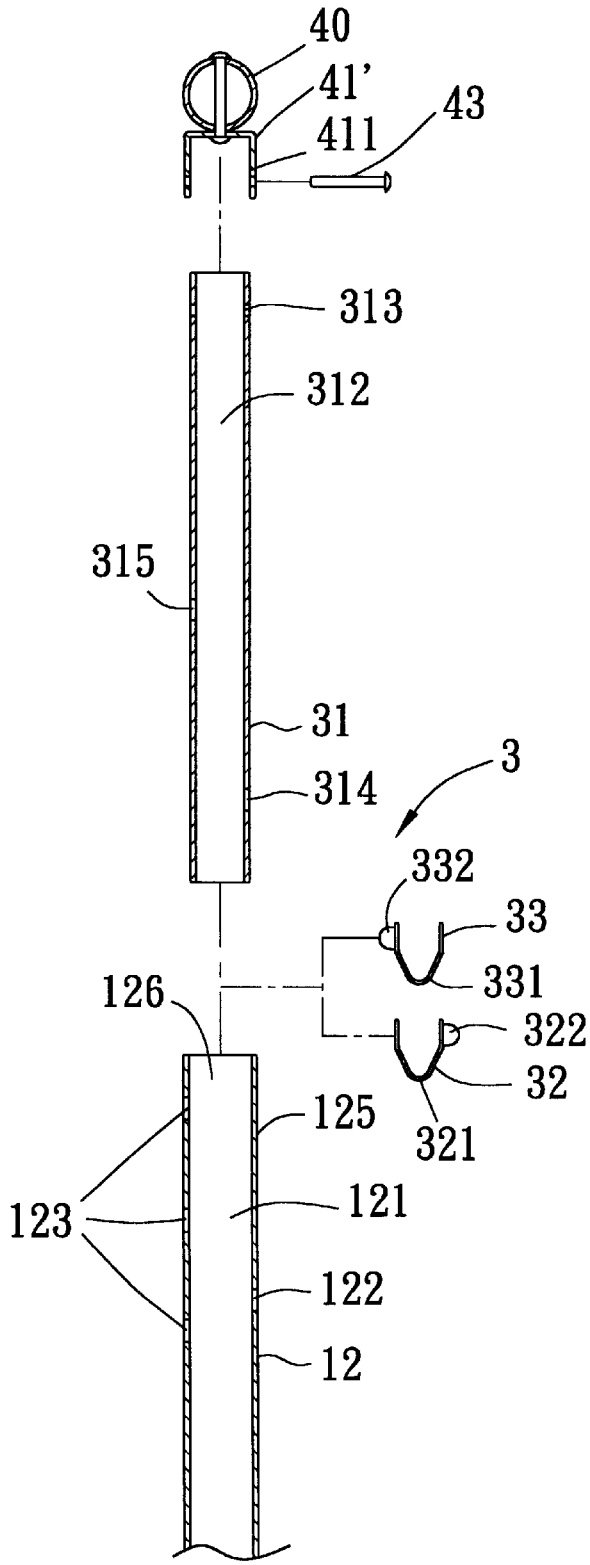
FIG. 3 is a fragmentary exploded sectional view illustrating the connections between a connecting rod and a front leg and between the connecting rod and a seat frame.

Referring to FIGS. 1 to 3, the preferred embodiment of the foldable chair frame according to the present invention is shown to include a pair of front legs 12, a pair of rear legs 22, a pair of extension units 3, and a seat frame 4.

The front legs 12 are connected to each other at lower end portions thereof by means of a transverse front connecting rod 11 which is adapted to be disposed on a ground surface. Each of the front legs 12 extends upwardly and rearwardly from its lower end portion, and has a tubular upper end portion 125 which confines an axial insert hole 121 with a top opening 126. The upper end portion 125 of each of the front legs 12 is formed with a radial retaining hole 122 at a lateral outer side opposite to the other one of the front legs 12, and three radial positioning holes 123 at a lateral inner side facing the other one of the front legs 12. The positioning holes 123 are displaced from and are aligned with one another in an axial direction.

The rear legs 22 are connected to each other at lower end portions thereof by a transverse rear connecting rod 21 which is adapted to be disposed on the ground surface. Each of the rear legs 22 extends forwardly and upwardly from its lower end portion, and has an upper end portion formed with a pivot hole 221, and an intermediate portion which is disposed at the lateral outer side of a respective one of the front legs 12, and which is connected pivotally to the intermediate portion of the respective one of the front legs 12 by means of a horizontal pivot shaft 23.

Each of the extension units 3 includes an adjustable extension rod 31, a resilient positioning member 33 and a resilient retaining member 32. The extension rod 31 is tubular in shape, and confines an axial passage 312 therethrough. The extension rod 31 has an open lower end portion extending slidably into the upper end portion 125 of a respective one of the front legs 12 via the top opening 126, and an upper end portion formed with a pivot hole 313. The lower end portion of each of the extension rods 31 is formed with a radial first mounting hole 315 at a lateral inner side thereof for alignment with a selected one of the radial positioning holes 123 in the upper end portion 125 of a respective one of the front legs 12, and a radial second mounting hole 314 at a lateral outer side thereof for alignment with the radial retaining hole 122 in the upper end portion 125 of the respective one of the front legs 12.

The positioning member 33 and the retaining member 32 are retained resiliently in the axial passage 312 in the extension rod 31. Each of the positioning member 33 and the retaining member 32 includes a spring plate 331, 321 with two lateral plate portions which cooperatively form a generally V-shaped structure. The positioning member 33 has a positioning protrusion 332 formed on an outer side of one of the lateral plate portions thereof for projecting through the first mounting hole 315 in the extension rod 31. The retaining member 32 has a retaining protrusion 322 formed on an outer side of one of the lateral plate portions thereof for projecting through the second mounting hole 314 in the extension rod 31.

The seat frame 4 includes a generally annular frame portion 40 with front and rear parts. In other embodiments, the frame portion may be formed in other shapes, such as rectangular or oval. A pair of front pivot seats 41 and a pair of rear pivot seats 41' are welded to a bottom side of the frame portion 40 at two lateral sides of the front and rear parts of the frame portion 40. Each of the front and rear pivot seats 41, 41' has a parallel pair of downwardly extending pivot lobes 411. The upper end portion of each of the rear legs 22 extends between the pivot lobes 411 of a respective one the front pivot seats 41, and is connected pivotally to the front pivot seat 41 by means of a pivot pin 42 that extends transversely through the pivot lobes 411 and the pivot hole 221 in the upper end portion of the respective rear leg 22. The upper end portion of each of the extension rods 31 extends between the pivot lobes 411 of a respective one of the rear pivot seats 41', and is connected pivotally to the rear pivot seat 41' by means of a pivot pin 43 that extends transversely through the pivot lobes 411 and the pivot hole 313 in the upper end portion of the respective extension rod 31. A fabric piece 5 is mounted on the frame portion 40 of the seat frame 4 to form a seat.

After assembly, the front and rear legs 12, 22 cross each other, and the seat frame 4 is inclined in a manner that the rear part of the annular frame portion 40 is disposed at a higher position than the front part such that a backrest is provided by the fabric piece 5. The positioning protrusion 332 on each of the positioning members 33 projects through the first mounting hole 315 in a respective one of the extension rods 31, and projects into a selected one of the positioning holes 123 in a corresponding one of the front legs 12 for engaging the selected positioning hole 123, thereby positioning the extension rod 31 on the respective front leg 12. When the positioning member 33 in each of the extension rods 31 engages an uppermost one of the positioning holes 123 in the respective one of the front legs 12, the retaining protrusion 322 of each of the retaining members 32 projects into the retaining hole 122 in the upper end portion 125 of the respective front leg 12 for engaging the retaining hole 122. The retaining protrusions 322 help secure the extension rods 31 on the front legs 12 when the positioning protrusions 332 engage an uppermost pair of the positioning holes 123, where only a relatively short section of each of the extension rods 31 is disposed in the respective front leg 12.

Figure 4:
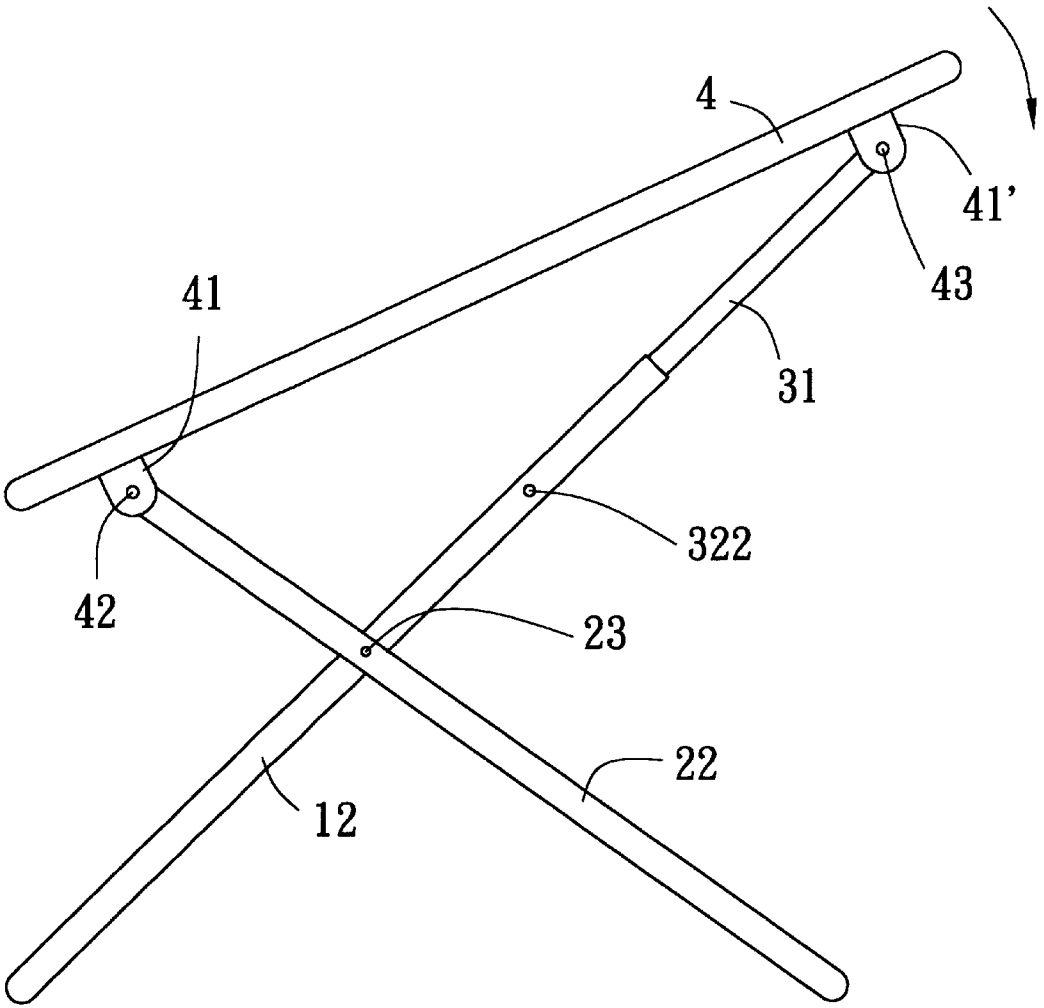
FIG. 4 is another side view of the preferred embodiment, illustrating the seat frame positioned at another inclination.

Referring to FIGS. 3 and 4, to adjust the inclination of the seat frame 4, the retaining protrusions 322 of the retaining members 32 are depressed for retracting into the second mounting holes 314 and for disengaging from the retaining holes 122, and the positioning protrusions 332 of the positioning members 33 are depressed for retracting into the first mounting holes 315 and for disengaging from the uppermost pair of the positioning holes 123, thereby permitting sliding movement of the extension rods 31 relative to the front legs 12 for adjustment of the inclination of the seat frame 4. After the seat frame 4 is adjusted to a desired inclination, the positioning protrusions 332 are released for engaging the selected positioning holes 123 so as to position the seat frame 4 at the adjusted inclination. It is noted that, the retaining protrusions 322 engage the retaining holes 122 only in the case the positioning protrusions 332 engage the uppermost pair of the positioning holes 123 to enhance strength of the connection between the lower end portions of the extension rods 31 and the upper end portions 125 of the front legs 12.

Figure 5:
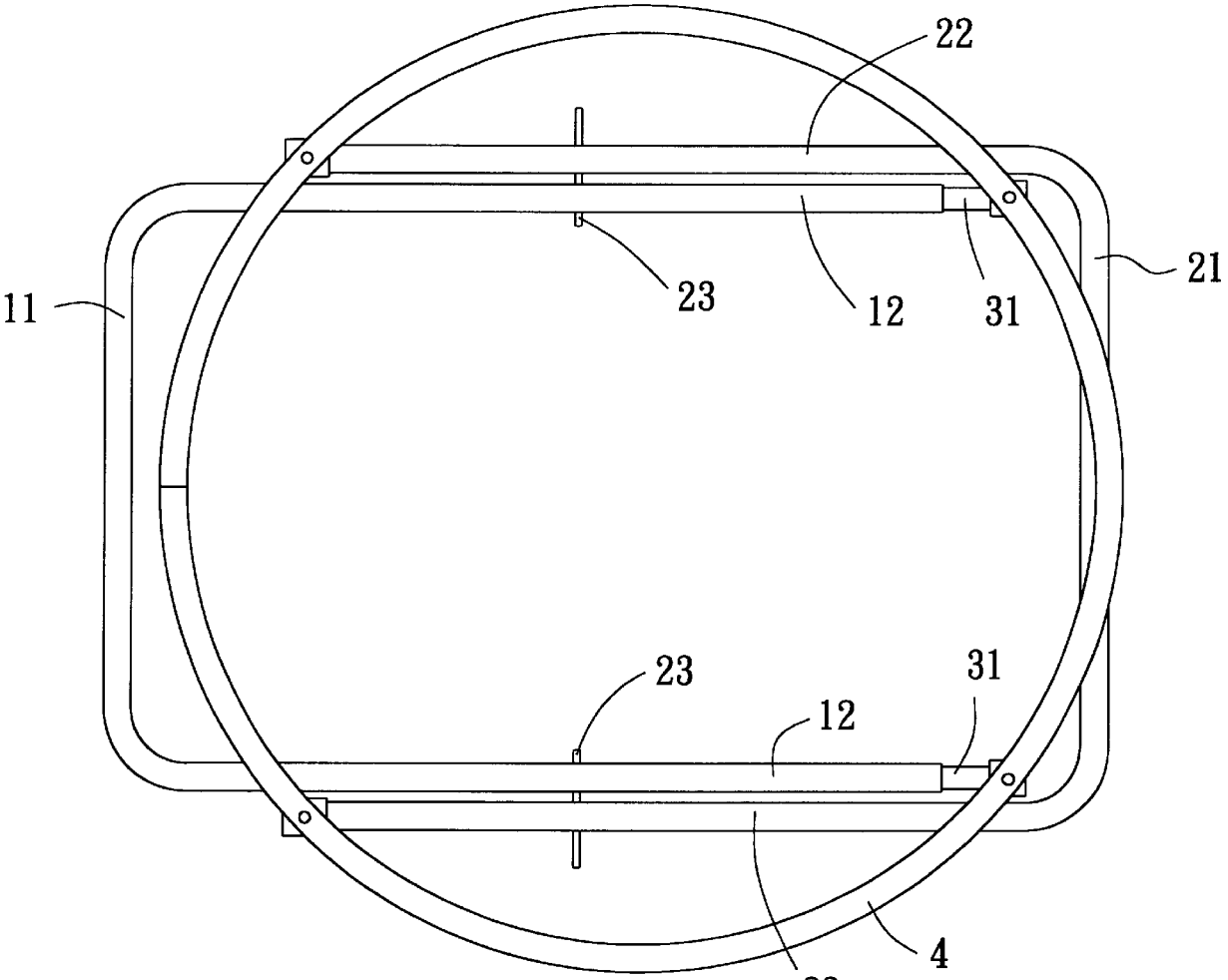
FIG. 5 is a top view showing the preferred embodiment in a folded state.

To fold the chair frame of the present embodiment, the positioning protrusions 332 are depressed for disengaging from the positioning holes 123 to permit sliding movement of the extension rods 31 relative to the front legs 12, thereby permitting retraction of the extension rods 31 into the upper end portion 125 of the front legs 12, in the case the positioning protrusions 332 engage the lowermost pair of the positioning holes 123 or the intermediate pair of the positioning holes 123. When the positioning protrusions 332 engage the uppermost pair of the positioning holes 123, both the positioning protrusions 332 and the retaining protrusions 322 are depressed to permit retraction of the extension rods 31 into the front legs 12. Thereafter, the front and rear legs 12, 22 are turned about the pivot shafts 23 in a manner that the front and rear connecting rods 11, 21 move away from each other, as shown in FIG. 5, so as to fold the front and rear legs 12, 22 upon a bottom side of the seat frame 4.

Accordingly, with the provision of the extension units 3, the seat frame 4 of the chair frame of the present invention can be positioned at a desired inclination. The chair frame of the present invention has a relatively simple structure, and a reduced thickness after folding.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable chair frame comprising:

a front leg having a lower end portion adapted to be supported on a ground surface, a tubular upper end portion which extends upwardly and rearwardly from said lower end portion and which confines an axial insert hole with a top opening, and an intermediate portion between said lower end portion and said tubular upper end portion, said upper end portion being formed with at least one radial positioning hole;

a rear leg having a lower end portion adapted to be supported on the ground surface, an upper end portion which extends upwardly and forwardly from said lower end portion of said rear leg, and an intermediate portion connected pivotally to said intermediate portion of said front leg;

an adjustable extension rod having a lower end portion extending into said axial insert hole in said upper end portion of said front leg via said top opening, and an upper end portion, said lower end portion of said extension rod being provided with a resilient positioning protrusion which projects radially into said positioning hole for engaging said positioning hole so as to position said lower end portion of said extension rod on said upper end portion of said front leg; and a seat frame disposed above said front and rear legs and said extension rod, and having a rear part connected pivotally to said upper end portion of said extension rod, and a front part connected pivotally to said upper end portion of said rear leg;

said positioning protrusion being depressible for disengaging from said positioning hole to permit sliding movement of said extension rod relative to said front leg, thereby permitting said extension rod to retract into said upper end portion of said front leg, and thereby permitting folding of said front and rear legs toward said seat frame.

2. The foldable chair frame as claimed in claim 1, wherein said extension rod is tubular in shape and confines an axial passage with a radial mounting hole, and has a resilient positioning member received in said axial passage, said resilient positioning protrusion being formed on said resilient positioning member.

3. The foldable chair frame as claimed in claim 2, wherein said positioning member includes a spring plate with two lateral plate portions which cooperatively form a generally V-shaped structure, said positioning protrusion being formed on an outer side of one of said lateral plate portions opposite to the other one of said lateral plate portions.

4. The foldable chair frame as claimed in claim 1, wherein said upper end portion of said front leg is further formed with a radial retaining hole, said lower end portion of said extension rod further having a resilient retaining protrusion which projects resiliently and radially into said retaining hole in said front leg to help secure said extension rod on said front leg, said retaining protrusion being depressible for disengaging from said retaining hole so as to permit sliding movement of said extension rod relative to said front leg when said retaining protrusion and said positioning protrusion are depressed.

5. The foldable chair frame as claimed in claim 4, wherein said extension rod is tubular in shape and confines an axial passage with a radial mounting hole, and has a resilient retaining member received in said axial passage, said resilient retaining protrusion being formed on said resilient retaining member.

6. The foldable chair frame as claimed in claim 5, wherein said retaining member includes a spring plate having two lateral plate portions which cooperatively form a generally V-shaped structure, said retaining protrusion being formed on an outer side of one of said lateral plate portions opposite to the other one of said lateral plate portions.

7. The foldable chair frame as claimed in claim 1, wherein said upper end portion of said front leg is formed with at least two of said radial positioning holes which are aligned with and displaced from each other in an axial direction, said positioning protrusion being extendible into a selected one of said radial positioning holes for engaging the selected one of said radial positioning holes in order to position said seat frame at a desired inclination.

8. The foldable chair frame as claimed in claim 1, wherein said seat frame has front and rear pivot seats at said front and rear parts, respectively, each of said pivot seats including a parallel pair of pivot lobes which extend downwardly from said seat frame, said upper end portion of said extension rod being disposed between said pivot lobes of said rear pivot seat, said upper end portion of said rear leg being disposed between said pivot lobes of said front pivot seat, each of said front and rear pivot seats further including a pivot pin extending transversely through said pivot lobes for mounting pivotally said upper end portion of a respective one of said extension rod and said rear leg on a corresponding one of said rear and front pivot seats.

* * * * *

UNITED STATES PATENT AND TRADEMARK OFFICE
Certificate

Patent No. 6,332,646 B1 Patented: December 25, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Chun-Hsien Tseng, Chiayi Hsien (TW); Brenda Chen, Chiayi Hsien (TW); and Chin Lin, Chiayi Hsien (TW).

Signed and Sealed this Thirtieth Day of June 2009.

DAVID DUNN
*Supervisory Patent Examiner*
Art Unit 3636

US006332646C1

(12) INTER PARTES REEXAMINATION CERTIFICATE (0239th)

United States Patent
Tseng et al.

(10) Number: US 6,332,646 C1
(45) Certificate Issued: Mar. 8, 2011

(54) FOLDABLE CHAIR FRAME

(75) Inventors: Chun-Hsien Tseng, Chiayi Hsien (TW); Brenda Chen, Chiayi Hsien (TW); Chin Lin, Chiayi Hsien (TW)

(73) Assignee: Chia Yi Chin Jwu Enterprise Co., Ltd., Lu Man Tsun, Chu-chi Hsiang, Chiayi Hsien (TW)

Reexamination Request:
No. 95/001,226, Aug. 25, 2009

Reexamination Certificate for:

| | |
|---|---|
| Patent No.: | **6,332,646** |
| Issued: | **Dec. 25, 2001** |
| Appl. No.: | **09/626,396** |
| Filed: | **Jul. 26, 2000** |

Certificate of Correction issued Jun. 30, 2009.

(51) Int. Cl.

| | |
|---|---|
| ***A47C 4/00*** | (2006.01) |
| ***A47C 4/44*** | (2006.01) |
| ***A47C 4/48*** | (2006.01) |

(52) U.S. Cl. ..... 297/16.1; 297/19; 297/46; 297/56

(58) Field of Classification Search ..... 297/16.1, 297/19, 46, 56

See application file for complete search history.

(56) References Cited

U.S. PATENT DOCUMENTS

| | | | | |
|---|---|---|---|---|
| 3,004,793 | A | * 10/1961 | Loomis | 297/274 |
| 4,045,045 | A | 8/1977 | Boucher | |
| D248,516 | S | 7/1978 | Johansson | |
| 5,848,822 | A | 12/1998 | Wu | |
| 6,056,354 | A | 5/2000 | Tseng | |

FOREIGN PATENT DOCUMENTS

| | | |
|---|---|---|
| CN | 2188885 Y | 2/1995 |
| GB | 599760 | 5/1948 |
| JP | 50-123508 | 3/1975 |
| JP | 51-127856 | 11/1976 |

* cited by examiner

*Primary Examiner*—Jimmy G Foster

(57) ABSTRACT

A foldable chair frame includes pivotally connected front and rear legs. The front leg has a tubular upper end portion which confines an axial insert hole and which is formed with a radial positioning hole. An extension rod has a lower end portion extending axially into the upper end portion of the front leg, and is provided with a resilient positioning protrusion which projects radially into the positioning hole for positioning the extension rod on the front leg. A seat frame has a rear part pivoted to the upper end portion of the extension rod, and a front part pivoted to the upper end portion of the rear leg. The positioning protrusion is depressible for disengaging from the positioning hole to permit retraction of the extension rod into the front leg, thereby permitting folding of the front and rear legs toward the seat frame.

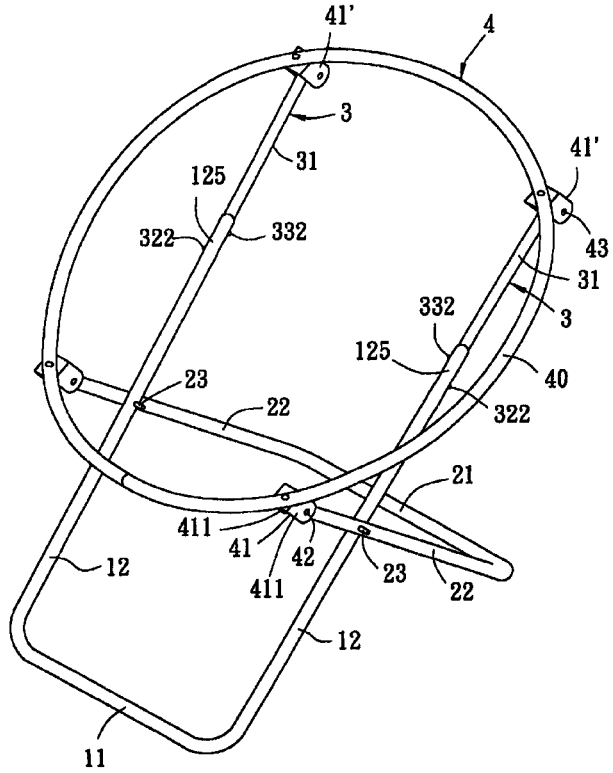

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-8 is confirmed.

New claims 9-22 are added and determined to be patentable.

*9. The foldable chair frame as claimed in claim 1, wherein said pivotal connection of said intermediate portions of said front leg to said rear leg permit a folding of said front and rear legs toward said seat frame so that said front leg and said rear leg fold upon a bottom side of the seat frame.*

*10. The foldable chair frame as claimed in claim 1, wherein retraction of said adjustable extension rod into said upper end portion of said front leg is accompanied by a pivotal folding of said front and rear legs toward said seat frame.*

*11. The foldable chair frame as claimed in claim 1, wherein sliding movement of said extension rod relative to said front leg during folding of the chair frame is accompanied by movement of said lower end portions of the front and rear legs away from each other.*

*12. The foldable chair frame as claimed in claim 1, wherein said lower end portion of said front leg that is adapted to be supported on a ground surface comprises a transverse front connecting rod and said lower end portion of said rear leg that is adapted to be supported on a ground surface comprises a transverse rear connecting rod.*

*13. The foldable chair frame as claimed in claim 12, wherein sliding movement of said extension rod relative to said front leg during folding of the chair frame is accompanied by movement of said transverse front connecting rod and said transverse rear connecting rod away from each other.*

*14. The foldable chair frame as claimed in claim 1, wherein said pivotal connection of said intermediate portions of said front leg to said rear leg, said pivotal connection of said seat frame to said upper end portion of both said extension rod and said rear leg, and said lower end portion of said adjustable extension rod disposed to extend into said front leg, cooperate to retract said adjustable extension rod into said upper end portion of said front leg while said front and rear legs pivot toward said seat frame.*

*15. The foldable chair frame as claimed in claim 14, wherein said connections further cooperate to move said lower end portions of the front and rear legs away from each other during folding of the chair frame.*

*16. The foldable chair frame as claimed in claim 14, wherein said extension rod is tubular in shape and confines an axial passage with a radial mounting hole, and has a resilient positioning member received in said axial passage, said resilient positioning protrusion being formed on said resilient positioning member.*

*17. The foldable chair frame as claimed in claim 16, wherein said positioning member includes a spring plate with two lateral plate portions which cooperatively form a generally V-shaped structure, said positioning protrusion being formed on an outer side of one of said lateral plate portions opposite to the other one of said lateral plate portions.*

*18. The foldable chair frame as claimed in claim 14, wherein said upper end portion of said front leg is further formed with a radial retaining hole, said lower end portion of said extension rod further having a resilient retaining protrusion which projects resiliently and radially into said retaining hole in said front leg to help secure said extension rod on said front leg, said retaining protrusion being depressible for disengaging from said retaining hole so as to permit sliding movement of said extension rod relative to said front leg when said retaining protrusion and said positioning protrusion are depressed.*

*19. The foldable chair frame as claimed in claim 18, wherein said extension rod is tubular in shape and confines an axial passage with a radial mounting hole, and has a resilient retaining member received in said axial passage, said resilient retaining protrusion being formed on said resilient retaining member.*

*20. The foldable chair frame as claimed in claim 19, wherein said retaining member includes a spring plate having two lateral plate portions which cooperatively form a generally V-shaped structure, said retaining protrusion being formed on an outer side of one of said lateral plate portions opposite to the other one of said lateral plate portions.*

*21. The foldable chair frame as claimed in claim 14, wherein said upper end portion of said front leg is formed with at least two of said radial positioning holes which are aligned with and displaced from each other in an axial direction, said positioning protrusion being extendible into a selected one of said radial positioning holes for engaging the selected one of said radial positioning holes in order to position said seat frame at a desired inclination.*

*22. The foldable chair frame as claimed in claim 14, wherein said seat frame has front and rear pivot seats at said front and rear parts, respectively, each of said pivot seats including a parallel pair of pivot lobes which extend downwardly from said seat frame, said upper end portion of said extension rod being disposed between said pivot lobes of said rear pivot seat, said upper end portion of said rear leg being disposed between said pivot lobes of said front pivot seat, each of said front and rear pivot seats further including a pivot pin extending transversely through said pivot lobes for pivotally said upper end portion of a respective one of said extension rod and said rear leg on a corresponding one of said rear and front pivot seats.*

* * * * *